US011717088B2

(12) United States Patent
Chen et al.

(10) Patent No.: US 11,717,088 B2
(45) Date of Patent: Aug. 8, 2023

(54) ROCKING CHAIR

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 0 days.

(21) Appl. No.: 17/669,233

(22) Filed: Feb. 10, 2022

(65) Prior Publication Data

US 2022/0248855 A1 Aug. 11, 2022

(30) Foreign Application Priority Data

Feb. 10, 2021 (CN) ..... 202120374069.6

(51) Int. Cl.
*A47C 4/28* (2006.01)
*A47C 3/029* (2006.01)

(52) U.S. Cl.
CPC ..... *A47C 4/286* (2013.01); *A47C 3/029* (2013.01)

(58) Field of Classification Search
CPC ..... A47C 2/286; A47C 3/029
USPC ..... 297/32, 33
See application file for complete search history.

(56) References Cited

U.S. PATENT DOCUMENTS

| | | | | |
|---|---|---|---|---|
| 2,543,543 | A * | 2/1951 | Gomes | A47C 3/029 297/32 |
| 7,100,975 | B1 * | 9/2006 | Zheng | A47C 4/286 297/32 |
| 2018/0271290 | A1 * | 9/2018 | Yang | A47C 4/286 |
| 2020/0281356 | A1 * | 9/2020 | Yang | A47C 4/286 |
| 2020/0305606 | A1 * | 10/2020 | Chen | A47C 4/286 |

FOREIGN PATENT DOCUMENTS

CN 209965760 U 1/2020

* cited by examiner

*Primary Examiner* — Anthony D Barfield
(74) *Attorney, Agent, or Firm* — Bayramoglu Law Offices, LLC

(57) ABSTRACT

A rocking chair includes a foldable main body frame and a leg rest frame, where the leg rest frame includes two side support rods, two bottom rods and two slanting rods; first end portions of the two side support rods are pivotally connected to the main body frame, when the rocking chair is unfolded, second end portions of the side support rods are located forward and below the first end portions thereof; first end portions of the two bottom rods are pivotally connected to the main body frame, and second end portions of the two bottom rods are respectively pivotally connected to the two side support rods; when the rocking chair is unfolded, the first end portions of the side support rods are located above the first end portions of the bottom rods; the two slanting rods intersect and are pivotally connected at an intersection.

17 Claims, 4 Drawing Sheets

ROCKING CHAIR

CROSS REFERENCE TO THE RELATED APPLICATIONS

This application is based upon and claims priority to Chinese Patent Application No. 202120374069.6, filed on Feb. 10, 2021, the entire contents of which are incorporated herein by reference.

TECHNICAL FIELD

The present application relates to the technical field of chairs, and in particular to a rocking chair.

BACKGROUND

Chinese Patent CN209965760U published on Jan. 21, 2020 provides a folding rocking chair and a folding mechanism. During use, the folding chair cannot provide support for the user's legs, resulting in a poor comfort level. To improve the comfort level, the present application performs improvements based on the folding chair.

SUMMARY

In order to solve the technical problem of low comfort of the existing folding rocking chair, the present application provides a rocking chair.

In order to solve the technical problem, the present application adopts the following technical solution. A rocking chair includes a foldable main body frame and a leg rest frame, where the leg rest frame includes:

two side support rods, where first end portions of the two side support rods are pivotally connected to the main body frame; and when the rocking chair is unfolded, second end portions of the side support rods are located forward and below the first end portions thereof;

two bottom rods, where first end portions of the two bottom rods are pivotally connected to the main body frame, and second end portions of the two bottom rods are respectively pivotally connected to the two side support rods; and when the rocking chair is unfolded, the first end portions of the side support rods are located above the first end portions of the bottom rods; and two slanting rods, where the two slanting rods intersect and are pivotally connected at an intersection; and first end portions of the two slanting rods are respectively hinged to the two side support rods, and second end portions of the two slanting rods are respectively hinged to the two bottom rods.

Preferably, the main body frame may include two folding mechanisms mirror-symmetric about a center plane; and the two folding mechanisms each include:

a rocker, including an arc-shaped ground contact portion;

a first support rod, where a first end portion of the first support rod may be pivotally connected to a first connecting member through a first pivot shaft; the first connecting member may be connected to the rocker and may be slidable along the rocker; and a second end portion of the first support rod may be fixedly connected to a second connecting member;

a first main rod, wherein a first end portion of the first main rod may be fixedly connected to a third connecting member; the third connecting member may be pivotally connected to a portion of the rocker close to a first end portion thereof through a third pivot shaft; the first connecting member may be located between a second end portion of the rocker and the third connecting member; and the first main rod may be pivotally connected to the second connecting member through a second pivot shaft;

a second support rod, where a first end portion of the second support rod may be pivotally connected to a fourth connecting member through a fourth pivot shaft; the fourth connecting member may be connected to the first main rod and may be slidable along the first main rod; and the fourth connecting member may be located between the second connecting member and the third connecting member; and a third support rod, where the third support rod may be pivotally connected to the second support rod through a fifth pivot shaft; a second end portion of the third support rod may be pivotally connected to a sixth connecting member through a sixth pivot shaft; the sixth connecting member may be connected to the first support rod and may be slidable along the first support rod; the sixth connecting member may be located between the first connecting member and the second connecting member; the first main rod may be pivotally connected to the third support rod through a ninth pivot shaft; on the first main rod, the ninth pivot shaft may be located between the second connecting member and the fourth connecting member, and on the third support rod, the ninth pivot shaft may be located between the fifth pivot shaft and the sixth connecting member; and the first pivot shaft, the second pivot shaft, the third pivot shaft, the fourth pivot shaft, the fifth pivot shaft, the sixth pivot shaft and the ninth pivot shaft may be parallel to each other.

Preferably, the first end portions of the two side support rods may be respectively pivotally connected to first end portions of two third support rods; and the first end portions of the two bottom rods may be respectively pivotally connected to first end portions of two rockers.

Preferably, the first end portions of the two side support rods may be respectively pivotally connected to first end portions of two third support rods; and the first end portions of the two bottom rods may be respectively pivotally connected to two third connecting members.

Preferably, the first end portions of the two side support rods may be respectively pivotally connected to first end portions of two third support rods; and the first end portions of the two bottom rods may be respectively pivotally connected to portions of two first main rods close to first end portions thereof.

Preferably, the first main rod may include a base rod and a backrest rod that may be bent relative to each other; and a second end portion of the base rod may be fixedly connected to or integrated with a first end portion of the backrest rod; and the second connecting member may be pivotally connected to a portion of the base rod close to the second end portion thereof; the third connecting member may be fixed to a first end portion of the base rod; and the fourth connecting member may be slidably connected to the base rod.

Preferably, the second connecting member may be provided with a clamping notch; and when the rocking chair may be folded, the rocker may be embedded into the clamping notch.

Preferably, the folding mechanisms each may further include an armrest; a first end portion of the armrest may be fixed to a seventh connecting member; a second end portion of the second support rod may be pivotally connected to the seventh connecting member through a seventh pivot shaft; the portion of the base rod close to the second end portion thereof may be pivotally connected to an eighth connecting member through an eighth pivot shaft; the eighth connecting member may be connected to the armrest and may be slidable along the armrest; and the seventh pivot shaft, the eighth pivot shaft and the first pivot shaft may be parallel to each other.

Preferably, the ground contact portion may be an arc surface formed continuously along a length direction of the rocker by multiple mutually parallel straight lines.

Preferably, the second connecting member may include a first limiting portion with a first limiting notch; and the second pivot shaft may penetrate through the base rod and two side walls forming the first limiting notch; and when the rocking chair may be unfolded, the base rod falls into the first limiting notch and may be supported by a bottom of the first limiting notch.

Preferably, the third connecting member may include a second limiting portion with a second limiting notch; and the third pivot shaft may penetrate through the rocker and two side walls forming the second limiting notch; and when the rocking chair may be unfolded, the rocker may be embedded into the second limiting notch and pressed by a bottom of the second limiting notch.

Preferably, the rocking chair may further include a front intersecting mechanism and a rear intersecting mechanism;

the front intersecting mechanism may include a first front slanting rod and a second front slanting rod that intersect and may be pivotally connected at an intersection by a tenth pivot shaft; a first end portion of the first front slanting rod may be pivotally connected to a first angle cleat through an eleventh pivot shaft; a first end portion of the second front slanting rod may be pivotally connected to a second angle cleat through a twelfth pivot shaft; the first angle cleat may be pivotally connected to the third support rod of one of the folding mechanisms through a thirteenth pivot shaft; the second angle cleat may be pivotally connected to the third support rod of the other of the folding mechanisms through a fourteenth pivot shaft; the thirteenth pivot shaft and the fourteenth pivot shaft may be respectively near two fifth pivot shafts; alternatively, the thirteenth pivot shaft and the fourteenth pivot shaft may be respectively the two fifth pivot shafts; and the thirteenth pivot shaft and the fourteenth pivot shaft may be symmetric about the center plane;

a second end portion of the first front slanting rod may be pivotally connected to a third angle cleat through a fifteenth pivot shaft; a second end portion of the second front slanting rod may be pivotally connected to a fourth angle cleat through a sixteenth pivot shaft; the third angle cleat may be pivotally connected to the third connecting member of one of the folding mechanisms through a seventeenth pivot shaft; the fourth angle cleat may be pivotally connected to the third connecting member of the other of the folding mechanisms through an eighteenth pivot shaft; and the seventeenth pivot shaft and the eighteenth pivot shaft may be symmetric about the center plane;

the tenth pivot shaft may be located in the center plane; the eleventh pivot shaft, the twelfth pivot shaft, the fifteenth pivot shaft and the sixteenth pivot shaft may be parallel to the tenth pivot shaft;

the rear intersecting mechanism may include a first rear slanting rod and a second rear slanting rod that intersect and may be pivotally connected at an intersection by a nineteenth pivot shaft; a first end portion of the first rear slanting rod may be pivotally connected to a fifth angle cleat through a twentieth pivot shaft; a first end portion of the second rear slanting rod may be pivotally connected to a sixth angle cleat through a twenty-first pivot shaft; the fifth angle cleat may be pivotally connected to the backrest rod of one of the folding mechanisms through a twenty-second pivot shaft; the sixth angle cleat may be pivotally connected to the backrest rod of the other of the folding mechanisms through a twenty-third pivot shaft; and the twenty-second pivot shaft and the twenty-third pivot shaft symmetric about the center plane;

a second end portion of the first rear slanting rod may be pivotally connected to a seventh angle cleat through a twenty-fourth pivot shaft; a second end portion of the second rear slanting rod may be pivotally connected to an eighth angle cleat through a twenty-fifth pivot shaft; the seventh angle cleat may be pivotally connected to the sixth connecting member of one of the folding mechanisms through a twenty-sixth pivot shaft; the eighth angle cleat may be pivotally connected to the sixth connecting member of the other of the folding mechanisms through a twenty-seventh pivot shaft; and the twenty-sixth pivot shaft and the twenty-seventh pivot shaft may be symmetric about the center plane; and the nineteenth pivot shaft may be located in the center plane; and the twentieth pivot shaft, the twenty-first pivot shaft, the twenty-fourth pivot shaft and the twenty-fifth pivot shaft may be parallel to the nineteenth pivot shaft.

Preferably, the twenty-sixth pivot shaft may be the sixth pivot shaft of one of the folding mechanisms, and the twenty-seventh pivot shaft may be the sixth pivot shaft of the other of the folding mechanisms; and the folding mechanisms each may further include a fifth connecting member; the fifth connecting member may be sleeved on the third support rod; the fifth pivot shaft may penetrate through the second support rod, the third support rod and the fifth connecting member; the first angle cleat may be pivotally connected to the fifth connecting member of one of the folding mechanisms through the thirteenth pivot shaft; and the second angle cleat may be pivotally connected to the fifth connecting member of the other of the folding mechanisms through the fourteenth pivot shaft.

Preferably, the armrest may be provided with a sliding groove, and the eighth connecting member may include a slider, the slider may be slidably fitted into the sliding groove; and the first connecting member may include a first sliding sleeve, the first sliding sleeve may be slidably sleeved on the rocker; and the fourth connecting member may include a second sliding sleeve, the second sliding sleeve may be slidably sleeved on the base rod.

Preferably, the two slanting rods may be pivotally connected by a twenty-eighth pivot shaft; the first end portions of the two slanting rods may be respectively pivotally connected to a ninth angle cleat and a tenth angle cleat at a twenty-ninth pivot shaft and a thirtieth pivot shaft; the ninth angle cleat and the tenth angle cleat may be respectively pivotally connected to the two side support rods at a thirty-first pivot shaft and a thirty-second pivot shaft; the second end portions of the two slanting rods may be respectively pivotally connected to an eleventh angle cleat and a twelfth angle cleat at a thirty-third pivot shaft and a thirty-fourth pivot shaft; and the eleventh angle cleat and the twelfth angle cleat may be respectively pivotally connected to the two bottom rods at a thirty-fifth pivot shaft and a thirty-sixth pivot shaft.

The present application has the following beneficial effects. The folding rocking chair of the present application adds a foldable leg rest portion to provide support for legs of a user, thereby improving user experience.

BRIEF DESCRIPTION OF THE DRAWINGS

The present application is described in further detail below with reference to the drawings and embodiments.

REFERENCE NUMERALS

Figure 1:
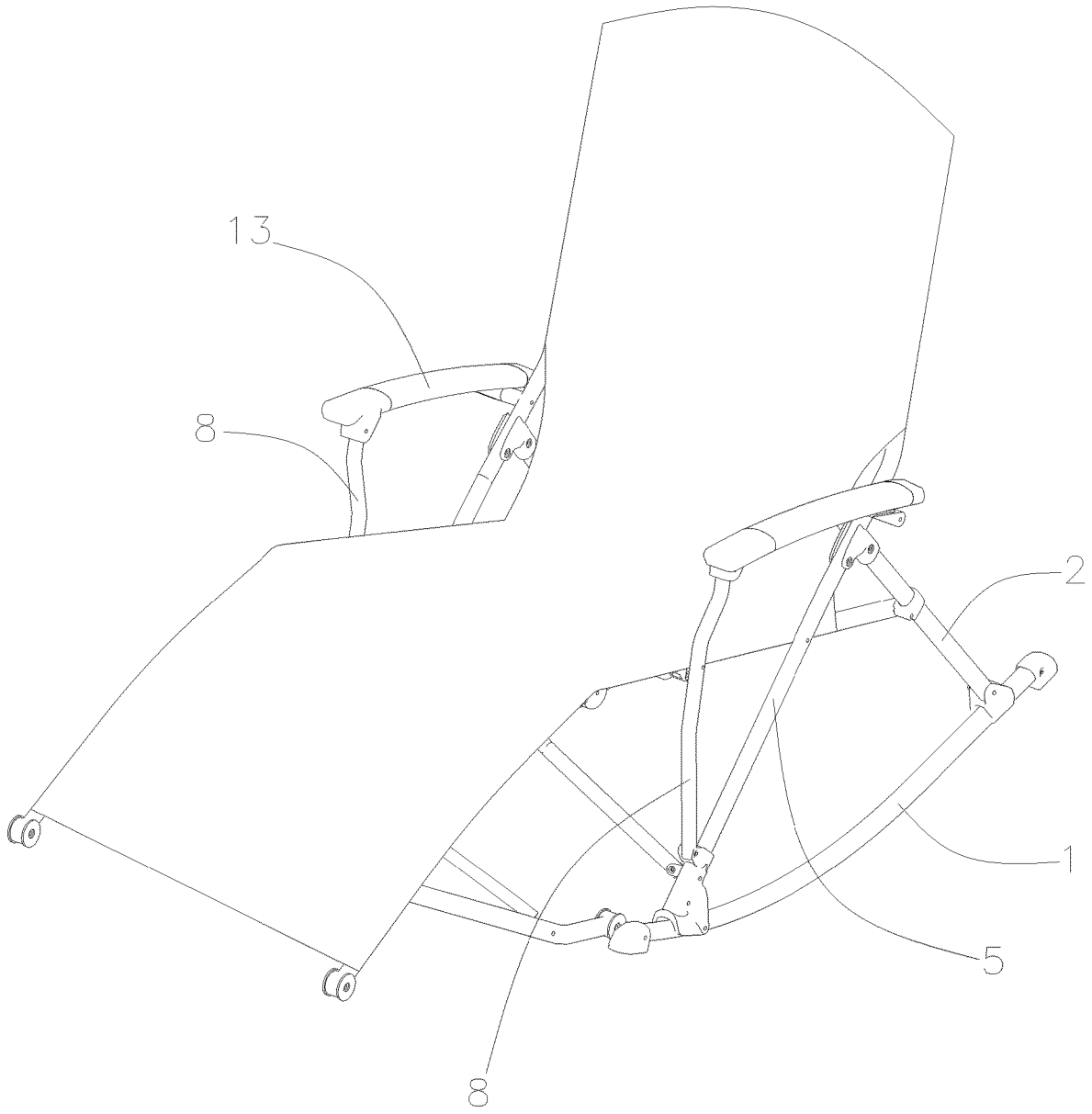
FIG. 1 is a structural view of a rocking chair according to a preferred embodiment of the present application.

1. rocker; 2. first support rod; 3. first connecting member; 4. second connecting member; 5. base rod; 6. backrest rod; 7. third connecting member; 8. second support rod; 9. fourth connecting member; 10. third support rod; 11. fifth connecting member; 12. sixth connecting member; 13. armrest; 14. seventh connecting member; 15. eighth connecting member; 16. first front slanting rod; 17. second front slanting rod; 18. first rear slanting rod; 19. second rear slanting rod; 20. side support rod; 21. bottom rod; 22. slanting rod; and 23. clamping notch.

DETAILED DESCRIPTION OF THE EMBODIMENTS

The embodiments of the present application are described below in detail. The embodiments are shown in the drawings. The same or similar numerals represent the same or similar elements or elements having the same or similar functions throughout the specification. The examples described below with reference to the accompanying drawings are exemplary, and are only used to explain present application but should not be construed as a limitation to present application.

Figure 2:
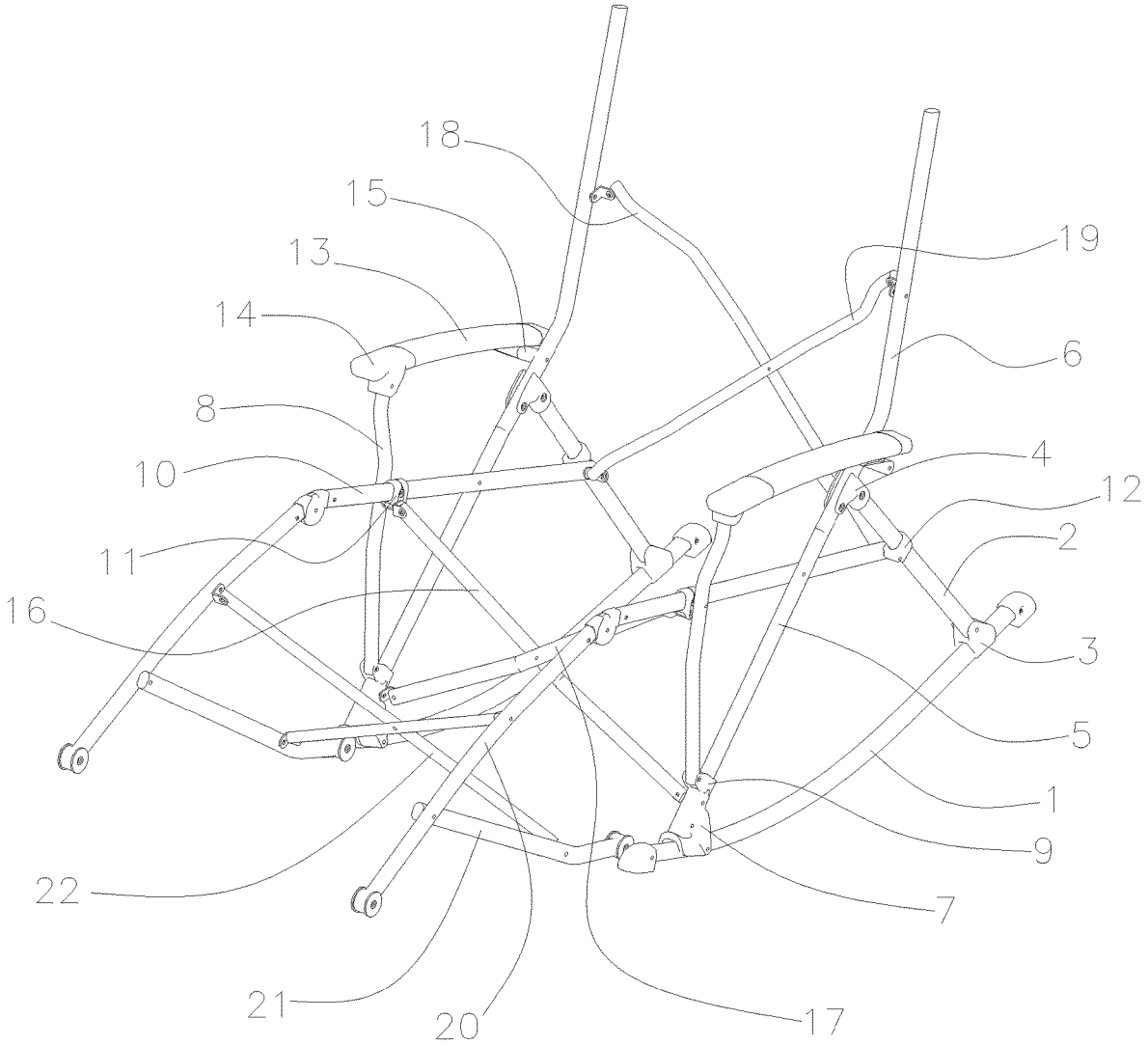
FIG. 2 is a structural view of the rocking chair with a main body frame and a leg rest frame unfolded according to a preferred embodiment of the present application.
Figure 3:
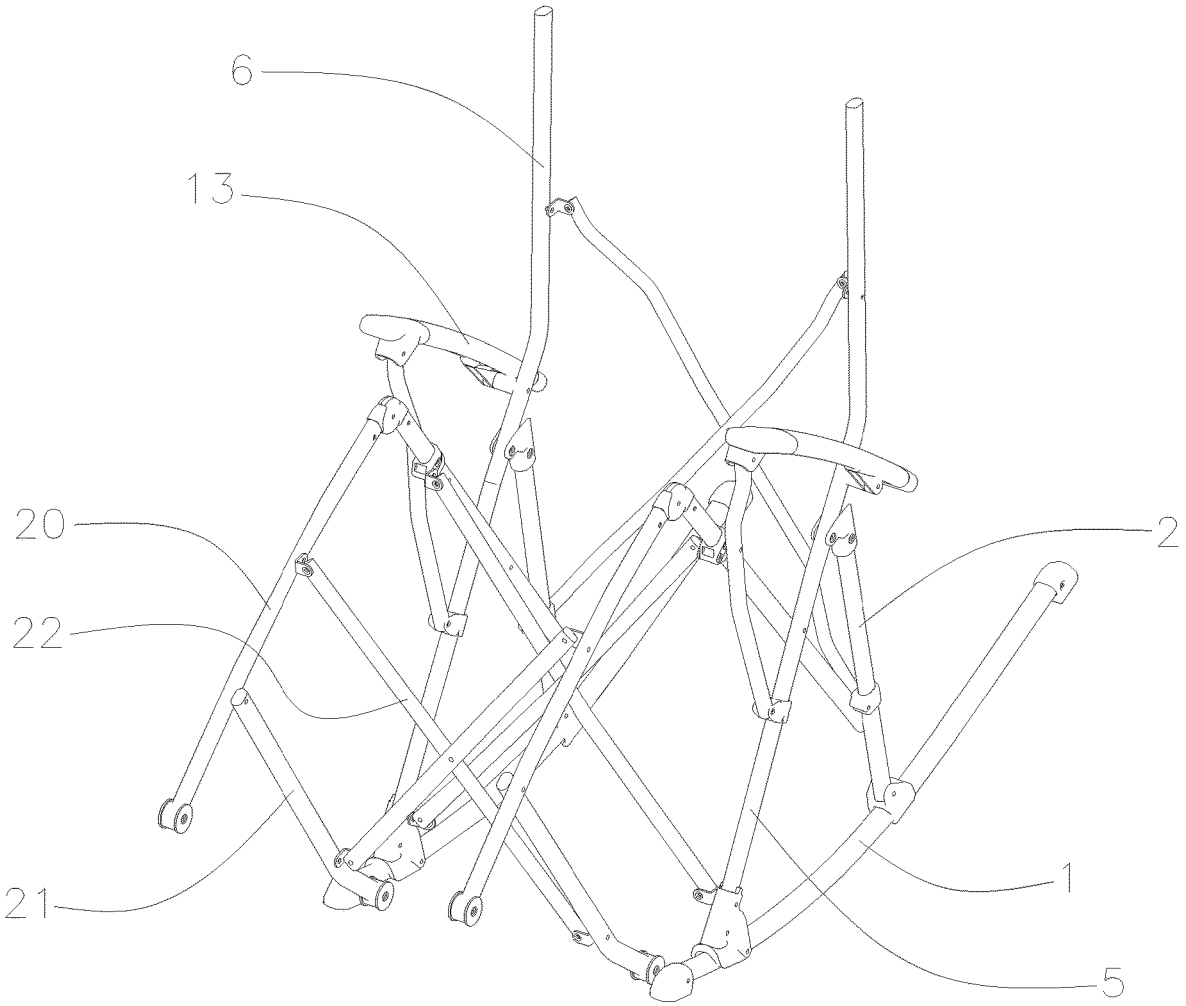
FIG. 3 is a structural view of the rocking chair with the main body frame and the leg rest frame half-folded according to a preferred embodiment of the present application.

FIG. 1 shows a rocking chair unfolded and laid flat on a ground according to Embodiment 1, and FIGS. 2 and 3 shows a support of the rocking chair in different folded states. The rocking chair includes two folding mechanisms mirror-symmetric about a center plane.

The folding mechanisms each include a rocker 1. The rocker 1 includes a ground contact portion. The ground contact portion contacts a ground when the rocking chair is rocked, so the ground contact portion is arc-shaped in a length direction of the rocker 1. Other parts of the rocker 1 are not limited to the arc shape, but may have any shape that does not hinder the rocking chair from rocking or affect the compactness of the rocking chair in a folded state. In this embodiment, the rocker 1 has an arc shape as a whole. A bottom surface of the rocker defines the ground contact portion. The ground contact portion is an arc surface formed continuously along the length direction of the rocker by multiple mutually parallel straight lines. When the rocking chair is unfolded and rests on the ground, the ground contact portion is in contact with the ground. When the rocking chair is rocked, the entire surface of the ground contact portion is in contact with the ground, which improves the stability of the rocking chair when it is rocked and prevents the rocking chair from shaking left and right. Two ends of the rocker 1 are sealed with plastic pieces.

The folding mechanisms each further include a first support rod 2. A first end portion of the first support rod 2 is pivotally connected to a first connecting member 3 through a first pivot shaft. The first connecting member 3 includes a first sliding sleeve. The first sliding sleeve is slidably sleeved on the rocker 1. A second end portion of the first support rod 2 is fixedly connected to a second connecting member 4. In the present application, a first end portion and a second end portion of a rod refer to edges of two ends of the rod, and a portion of the rod close to the first end portion refers to one which is close to the first end portion and connectable to other components. Those skilled in the art may set a specific distance based on common sense to describe a portion of a rod close to a first end portion. When the rocking chair is unfolded, the first end portion of the first support rod 2 is close to a second end portion of the rocker 1, and the second end portion of the first support rod 2 is inclined toward a front and upper direction of the rocking chair.

The folding mechanisms each further include a first main rod. The first main rod includes a base rod 5 and a backrest rod 6 that are bent relative to each other at an obtuse angle. A portion of the base rod 5 close to a second end portion thereof is pivotally connected to a second connecting member 4 through a second pivot shaft. The second connecting member 4 is L-shaped, and includes a sleeve with an integral structure and a first limiting portion with a first limiting notch. The second end portion of the first support rod 2 is inserted into the sleeve and fixed by a pin. The second pivot shaft penetrates through two side walls of the first limiting portion forming the first limiting notch and the base rod 5. When the rocking chair is unfolded, the base rod 5 falls into the first limiting notch and is supported by a bottom of the first limiting notch, thereby preventing the rocking chair from being further unfolded.

The first connecting member 3 is located between the second end portion of the rocker 1 and a third connecting member 7. The third connecting member 7 includes a sleeve and a second limiting portion with a second limiting notch. A first end portion of the base rod 5 is inserted into the sleeve and fixed by a pin. A third pivot shaft penetrates through two side walls of the second limiting portion forming the second limiting notch and the rocker 1, such that the third connecting member 7 is pivotally connected to a portion of the rocker 1 close to a first end portion thereof. When the rocking chair is unfolded, a second end portion of the base rod 5 is inclined toward a rear and upper direction of the rocking chair. The portion of the rocker 1 close to the first end portion thereof is embedded into the second limiting notch and pressed by a bottom of the second limiting notch, thereby preventing the rocking chair from being further unfolded.

The folding mechanisms each further include a second support rod 8. A first end portion of the second support rod 8 is pivotally connected to a fourth connecting member 9 through a fourth pivot shaft. The fourth connecting member 9 includes a second sliding sleeve. The second sliding sleeve is sleeved on the base rod 5 and is located between the second connecting member 4 and the third connecting member 7. The second sliding sleeve is slidable along the base rod 5. When the rocking chair is unfolded, the third connecting member 7 bears against the second sliding sleeve, thereby preventing the rocking chair from being further unfolded.

The folding mechanisms each further include a third support rod 10. A fifth connecting member 11 is sleeved on the third support rod 10 and is close to a first end portion of the third support rod 10. A fifth pivot shaft penetrates through the second support rod 8, the third support rod 10 and the fifth connecting member 11, such that the second support rod 8 is pivotally connected to the third support rod 10. A second end portion of the third support rod 10 is pivotally connected to a sixth connecting member 12 through a sixth pivot shaft. The sixth connecting member 12 includes a third sliding sleeve. The third sliding sleeve is sleeved on the first support rod 2 and is slidable along the first support rod 2. The sixth connecting member 12 is located between the first connecting member 3 and the second connecting member 4. The base rod 5 is pivotally connected to the third support rod 10 through a ninth pivot shaft. On the base rod 5, the ninth pivot shaft is located between the second connecting member 4 and the fourth connecting member 9, and on the third support rod 10, the ninth pivot shaft is located between the fifth pivot shaft and the sixth pivot shaft. The first pivot shaft, the second pivot shaft, the third pivot shaft, the fourth pivot shaft, the fifth pivot shaft, the sixth pivot shaft and the ninth pivot shaft are parallel to each other. The first pivot shaft is perpendicular to the center plane.

The folding mechanisms each further include an armrest 13. A first end portion of the armrest 13 is fixed to a seventh connecting member 14. A second end portion of the second support rod 8 is higher than the fifth pivot shaft by a distance. The second end portion of the second support rod 8 is pivotally connected to the seventh connecting member 14 through a seventh pivot shaft. A portion of the base rod 5 close to the second end portion thereof is pivotally connected to an eighth connecting member 15 through an eighth pivot shaft. The eighth connecting member 15 includes a slider. A bottom of the armrest 13 is provided with a sliding groove extending along a length of the armrest 13. The slider is slidably fitted with the sliding groove. The seventh pivot shaft, the eighth pivot shaft and the first pivot shaft are parallel to each other. A second end portion of the armrest 13 is sealed with a plastic piece. When the rocking chair is unfolded, the slider slides towards the second end portion of the armrest 13 and is blocked by the plastic piece, thereby preventing the rocking chair from being further unfolded.

The rocking chair further includes a front intersecting mechanism and a rear intersecting mechanism.

The front intersecting mechanism includes a first front slanting rod 16 and a second front slanting rod 17 that intersect and are pivotally connected at an intersection by a tenth pivot shaft. A first end portion of the first front slanting rod 16 is pivotally connected to a first angle cleat through an eleventh pivot shaft. A first end portion of the second front slanting rod 17 is pivotally connected to a second angle cleat through a twelfth pivot shaft. The first angle cleat is pivotally connected to the fifth connecting member 11 of one of the folding mechanisms through a thirteenth pivot shaft. The second angle cleat is pivotally connected to the fifth connecting member 11 of the other of the folding mechanisms through a fourteenth pivot shaft. In this embodiment, the thirteenth pivot shaft, the fourteenth pivot shaft and the fifth pivot shaft are all on the fifth connecting member 11. The thirteenth pivot shaft is close to one fifth pivot shaft, and the fourteenth pivot shaft is close to the other fifth pivot shaft. The thirteenth pivot shaft and the fourteenth pivot shaft are perpendicular to the center plane and are symmetric about the center plane. In other embodiments, the thirteenth pivot shaft and the fourteenth pivot shaft are respectively the two fifth pivot shafts.

A second end portion of the first front slanting rod 16 is pivotally connected to a third angle cleat through a fifteenth pivot shaft. A second end portion of the second front slanting rod 17 is pivotally connected to a fourth angle cleat through a sixteenth pivot shaft. The third angle cleat is pivotally connected to the third connecting member 7 of one of the folding mechanisms through the seventeenth pivot shaft. The fourth angle cleat is pivotally connected to the third connecting member 7 of the other of the folding mechanisms through an eighteenth pivot shaft. The seventeenth pivot shaft and the eighteenth pivot shaft are perpendicular to the center plane and are symmetric about the center plane. The tenth pivot shaft is located in the center plane. The eleventh pivot shaft, the twelfth pivot shaft, the fifteenth pivot shaft and the sixteenth pivot shaft are parallel to the tenth pivot shaft.

The rear intersecting mechanism includes a first rear slanting rod 18 and a second rear slanting rod 19 that intersect and are pivotally connected at an intersection by the nineteenth pivot shaft. A first end portion of the first rear slanting rod 18 is pivotally connected to a fifth angle cleat through a twentieth pivot shaft. A first end portion of the second rear slanting rod 19 is pivotally connected to a sixth angle cleat through a twenty-first pivot shaft. The fifth angle cleat is pivotally connected to the backrest rod 6 of one of the folding mechanisms through a twenty-second pivot shaft. The sixth angle cleat is pivotally connected to the backrest rod 6 of the other of the folding mechanisms through a twenty-third pivot shaft. The twenty-second pivot shaft and the twenty-third pivot shaft are perpendicular to the center plane and are symmetric about the center plane.

A second end portion of the first rear slanting rod 18 is pivotally connected to a seventh angle cleat through a twenty-fourth pivot shaft. A second end portion of the second rear slanting rod 19 is pivotally connected to an eighth angle cleat through a twenty-fifth pivot shaft. The seventh angle cleat is pivotally connected to the sixth connecting member 12 of one of the folding mechanisms through a twenty-sixth pivot shaft. The eighth angle cleat is pivotally connected to the sixth connecting member 12 of the other of the folding mechanisms through a twenty-seventh pivot shaft. The twenty-sixth pivot shaft and the twenty-seventh pivot shaft are perpendicular to the center plane and are symmetric about the center plane. The nineteenth pivot shaft is located in the center plane. The twentieth pivot shaft, the twenty-first pivot shaft, the twenty-fourth pivot shaft and the twenty-fifth pivot shaft are parallel to the nineteenth pivot shaft. The twenty-sixth pivot shaft is the sixth pivot shaft of one of the folding mechanisms, and the twenty-seventh pivot shaft is the sixth pivot shaft of the other of the folding mechanisms. In some other embodiments, the twenty-sixth pivot shaft and the twenty-seventh pivot shaft are different from the sixth pivot shafts.

The rocking chair further includes a leg rest frame.

The leg rest frame includes:

two side support rods 20. First end portions of the two side support rods 20 are pivotally connected to the first end portions of the two third support rods 10, respectively. When the rocking chair is unfolded, second end portions of the side support rods 20 are located forward and below the first end portions thereof.

The leg rest further includes two bottom rods 21. First end portions of the two bottom rods 21 are pivotally connected to the first end portions of the two rockers 1, respectively. Second end portions of the two bottom rods 21 are pivotally connected to the two side support rods 20, respectively. When the rocking chair is unfolded, the first end portions of the side support rods 20 are located above the first end portions of the bottom rods 21.

The leg rest further includes two slanting rods 22. The two slanting rods 22 intersect and are pivotally connected at an intersection by a twenty-eighth pivot shaft. First end portions of the two slanting rods 22 are pivotally connected to a ninth angle cleat and a tenth angle cleat respectively on a twenty-ninth pivot shaft and a thirtieth pivot shaft. The ninth angle cleat and the tenth angle cleat are pivotally connected to the two side support rods 20 respectively at a thirty-first pivot shaft and a thirty-second pivot shaft. The thirty-first pivot shaft and the thirty-second pivot shaft are perpendicular to the center plane and are symmetric about the center plane. Second end portions of the two slanting rods 22 are pivotally connected to an eleventh angle cleat and a twelfth angle cleat at a thirty-third pivot shaft and a thirty-fourth pivot shaft, respectively. The eleventh angle cleat and the twelfth angle cleat and the two bottom rods 21 are pivotally connected to a thirty-fifth pivot shaft and a thirty-sixth pivot shaft, respectively. The thirty-fifth pivot shaft and the thirty-sixth pivot shaft are perpendicular to the center plane and are symmetric about the center plane. The twenty-eighth pivot shaft is located in the center plane and parallel to the twenty-ninth pivot shaft, the thirtieth pivot shaft, the thirty-third pivot shaft and the thirty-fourth pivot shaft.

In some other embodiments, the first end portions of the two bottom rods 21 are pivotally connected to the two third connecting members 7, respectively.

In some other embodiments, the first end portions of the two bottom rods 21 are respectively pivotally connected to the portions of the two base rods 5 close to the first end portions thereof.

Figure 4:
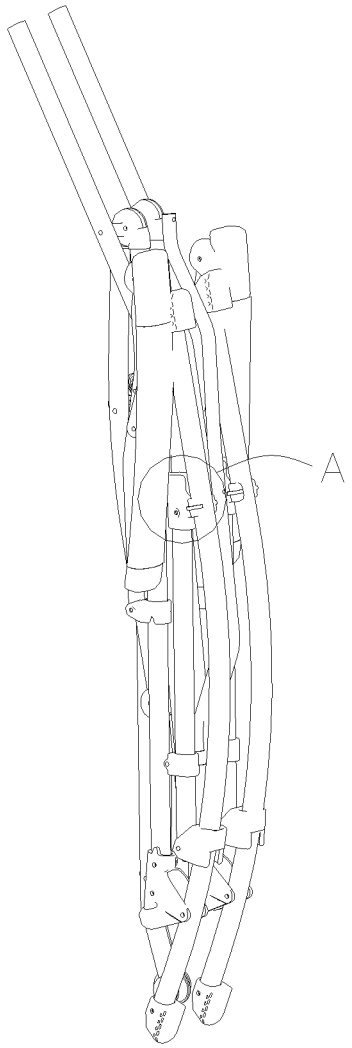
FIG. 4 is a structural view of the rocking chair with the main body frame and the leg rest frame folded according to a preferred embodiment of the present application.
Figure 5:
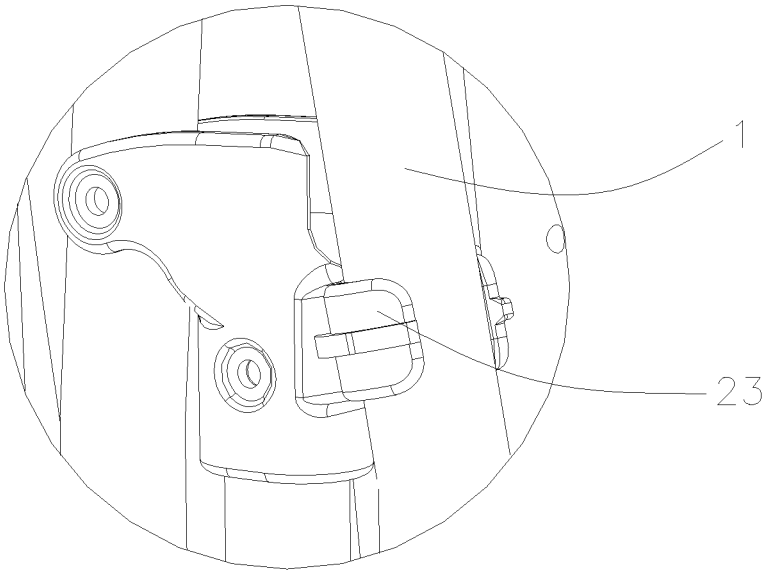
FIG. 5 is a detail view of A in FIG. 4.

In some other embodiments, as shown in FIGS. 4 and 5, the second connecting members are respectively provided with clamping notches 23. When the rocking chair is folded, the rockers 1 are inserted into the clamping notches 23.

As shown in FIG. 1, when the rocking chair is unfolded, since the base rods and the backrest rods are bent relative to each other, the backrest rods 6 are slightly inclined rearward. The first end portions of the third support rods 10 are at a certain distance from the fifth connecting members 11. A flexible material is hung on the first end portions of the backrest rods 6 and the first end portions of the third support rods 10 to form a seat cushion and a backrest. After the side support rods 20 are unfolded, they extend forward and downward from the first end portions of the third support rods 10, and a part of the flexible material is stretched by the two side support rods 20 to form a leg rest portion. A user lying on the rocking chair can rest his/her legs on the leg rest portion to obtain a comfortable lying position. As shown in FIGS. 4 and 5, to fold the rocking chair, the user holds the first end portions of the third support rods 10 and the first end portions of the backrest rods 6 respectively by his/her two hands and then applies a force with both hands. When the first connecting members 3 are slid to a position close to the third connecting members 7, it is difficult to manually fold the rocking chair further, but the rocking chair is not compact enough at this time. Since the third connecting members 7 are pivotally connected to the rockers 1, the second end portions of the rockers 1 can be lifted to make the first connecting members 3 closer to the third connecting members 7, such that the rocking chair is more compact after being folded. When the main body frame is folded, the leg rest frame is also folded and moved close to the main body frame. Finally, the rockers 1 are snapped into the clamping notches 23 to fix the folded rocking chair.

Inspired by the above ideal embodiments of the present application, those skilled in the art can make various changes and modifications through the above description without departing from the scope of the technical idea of the present application. The technical scope of the present application is subjected to the scope of the claims, and is not limited to the content of the specification.

What is claimed is:

1. A rocking chair, comprising a foldable main body frame and a leg rest frame, wherein the leg rest frame comprises:

two side support rods, wherein first end portions of the two side support rods are pivotally connected to the main body frame; and when the rocking chair is unfolded, second end portions of the two side support rods are located forward and below the first end portions of the two side support rods;

two bottom rods, wherein first end portions of the two bottom rods are pivotally connected to the main body frame, and second end portions of the two bottom rods are respectively pivotally connected to the two side support rods; and when the rocking chair is unfolded, the first end portions of the two side support rods are located above the first end portions of the two bottom rods; and two slanting rods, wherein the two slanting rods intersect and are pivotally connected at a first intersection; and first end portions of the two slanting rods are respectively hinged to the two side support rods, and second end portions of the two slanting rods are respectively hinged to the two bottom rods.

2. The rocking chair according to claim 1, wherein the main body frame comprises two folding mechanisms mirror-symmetric about a center plane; and each of the two folding mechanisms comprise:

a rocker, comprising an arc-shaped ground contact portion;

a first support rod, wherein a first end portion of the first support rod is pivotally connected to a first connecting member through a first pivot shaft; the first connecting member is connected to the rocker and the first connecting member is slidable along the rocker; and a second end portion of the first support rod is fixedly connected to a second connecting member;

a first main rod, wherein a first end portion of the first main rod is fixedly connected to a third connecting member; the third connecting member is pivotally connected to a portion of the rocker adjacent to a first end portion of the rocker through a third pivot shaft; the first connecting member is located between a second end portion of the rocker and the third connecting member; and the first main rod is pivotally connected to the second connecting member through a second pivot shaft;

a second support rod, wherein a first end portion of the second support rod is pivotally connected to a fourth connecting member through a fourth pivot shaft; the fourth connecting member is connected to the first main rod and the fourth connecting member is slidable along the first main rod; and the fourth connecting member is located between the second connecting member and the third connecting member; and a third support rod, wherein the third support rod is pivotally connected to the second support rod through a fifth pivot shaft; a second end portion of the third support rod is pivotally connected to a sixth connecting member through a sixth pivot shaft; the sixth connecting member is connected to the first support rod and the sixth connecting member is slidable along the first support rod; the sixth connecting member is located between the first connecting member and the second connecting member; the first main rod is pivotally connected to the third support rod through a ninth pivot shaft; on the first main rod, the ninth pivot shaft is located between the second connecting member and the fourth connecting member, and on the third support rod, the ninth pivot shaft is located between the fifth pivot shaft and the sixth connecting member; and the first pivot shaft, the second pivot shaft, the third pivot shaft, the fourth pivot shaft, the fifth pivot shaft, the sixth pivot shaft and the ninth pivot shaft are parallel to each other.

3. The rocking chair according to claim 2, wherein the first end portions of the two side support rods are respectively pivotally connected to first end portions of the two third support rods; and the first end portions of the two bottom rods are respectively pivotally connected to first end portions of the two rockers.

4. The rocking chair according to claim 2, wherein the first end portions of the two side support rods are respectively pivotally connected to first end portions of the two third support rods; and the first end portions of the two bottom rods are respectively pivotally connected to the two third connecting members.

5. The rocking chair according to claim 2, wherein the first end portions of the two side support rods are respectively pivotally connected to first end portions of the two third support rods; and the first end portions of the two bottom rods are respectively pivotally connected to portions of the two first main rods adjacent to first end portions of the two first main rods.

6. The rocking chair according to claim 2, wherein the first main rod comprises a base rod and a backrest rod, and the base rod and the backrest rod are bent relative to each other; and a second end portion of the base rod is fixedly connected to or integrated with a first end portion of the backrest rod;

the second connecting member is pivotally connected to a portion of the base rod adjacent to the second end portion of the base rod; the third connecting member is fixed to a first end portion of the base rod; and the fourth connecting member is slidably connected to the base rod;

the second connecting member is provided with a clamping notch; and when the rocking chair is folded, the rocker is embedded into the clamping notch;

each of the two folding mechanisms further comprises an armrest; a first end portion of the armrest is fixed to a seventh connecting member; a second end portion of the second support rod is pivotally connected to the seventh connecting member through a seventh pivot shaft; the portion of the base rod adjacent to the second end portion of the base rod is pivotally connected to an eighth connecting member through an eighth pivot shaft; the eighth connecting member is connected to the armrest and the eighth connecting member is slidable along the armrest; and the seventh pivot shaft, the eighth pivot shaft and the first pivot shaft are parallel to each other;

the second connecting member comprises a first limiting portion with a first limiting notch; and the second pivot shaft penetrates through the base rod and two side walls forming the first limiting notch;

when the rocking chair is unfolded, the base rod falls into the first limiting notch and the base rod is supported by a bottom of the first limiting notch;

the third connecting member comprises a second limiting portion with a second limiting notch; and the third pivot shaft penetrates through the rocker and two side walls forming the second limiting notch; and when the rocking chair is unfolded, the rocker is embedded into the second limiting notch and the rocker is pressed by a bottom of the second limiting notch.

7. The rocking chair according to claim 3, wherein the first main rod comprises a base rod and a backrest rod, and the base rod and the backrest rod are bent relative to each other; and a second end portion of the base rod is fixedly connected to or integrated with a first end portion of the backrest rod;

the second connecting member is pivotally connected to a portion of the base rod adjacent to the second end portion of the base rod; the third connecting member is fixed to a first end portion of the base rod; and the fourth connecting member is slidably connected to the base rod;

the second connecting member is provided with a clamping notch; and when the rocking chair is folded, the rocker is embedded into the clamping notch;

each of the two folding mechanisms further comprises an armrest; a first end portion of the armrest is fixed to a seventh connecting member; a second end portion of the second support rod is pivotally connected to the seventh connecting member through a seventh pivot shaft; the portion of the base rod adjacent to the second end portion of the base rod is pivotally connected to an eighth connecting member through an eighth pivot shaft; the eighth connecting member is connected to the armrest and the eighth connecting member is slidable along the armrest; and the seventh pivot shaft, the eighth pivot shaft and the first pivot shaft are parallel to each other;

the second connecting member comprises a first limiting portion with a first limiting notch; and the second pivot shaft penetrates through the base rod and two side walls forming the first limiting notch;

when the rocking chair is unfolded, the base rod falls into the first limiting notch and the base rod is supported by a bottom of the first limiting notch;

the third connecting member comprises a second limiting portion with a second limiting notch; and the third pivot shaft penetrates through the rocker and two side walls forming the second limiting notch; and when the rocking chair is unfolded, the rocker is embedded into the second limiting notch and the rocker is pressed by a bottom of the second limiting notch.

8. The rocking chair according to claim 4, wherein the first main rod comprises a base rod and a backrest rod, and the base rod and the backrest rod are bent relative to each other; and a second end portion of the base rod is fixedly connected to or integrated with a first end portion of the backrest rod;

the second connecting member is pivotally connected to a portion of the base rod adjacent to the second end portion of the base rod; the third connecting member is fixed to a first end portion of the base rod; and the fourth connecting member is slidably connected to the base rod;

the second connecting member is provided with a clamping notch; and when the rocking chair is folded, the rocker is embedded into the clamping notch;

each of the two folding mechanisms further comprises an armrest; a first end portion of the armrest is fixed to a seventh connecting member; a second end portion of the second support rod is pivotally connected to the seventh connecting member through a seventh pivot shaft; the portion of the base rod adjacent to the second end portion of the base rod is pivotally connected to an eighth connecting member through an eighth pivot shaft; the eighth connecting member is connected to the armrest and the eighth connecting member is slidable along the armrest; and the seventh pivot shaft, the eighth pivot shaft and the first pivot shaft are parallel to each other;

the second connecting member comprises a first limiting portion with a first limiting notch; and the second pivot shaft penetrates through the base rod and two side walls forming the first limiting notch;

when the rocking chair is unfolded, the base rod falls into the first limiting notch and the base rod is supported by a bottom of the first limiting notch;

the third connecting member comprises a second limiting portion with a second limiting notch; and the third pivot shaft penetrates through the rocker and two side walls forming the second limiting notch; and when the rocking chair is unfolded, the rocker is embedded into the second limiting notch and the rocker is pressed by a bottom of the second limiting notch.

9. The rocking chair according to claim 5, wherein the first main rod comprises a base rod and a backrest rod, and the base rod and the backrest rod are bent relative to each other; and a second end portion of the base rod is fixedly connected to or integrated with a first end portion of the backrest rod;

the second connecting member is pivotally connected to a portion of the base rod adjacent to the second end portion of the base rod; the third connecting member is fixed to a first end portion of the base rod; and the fourth connecting member is slidably connected to the base rod;

the second connecting member is provided with a clamping notch; and when the rocking chair is folded, the rocker is embedded into the clamping notch;

each of the two folding mechanisms further comprises an armrest; a first end portion of the armrest is fixed to a seventh connecting member; a second end portion of the second support rod is pivotally connected to the seventh connecting member through a seventh pivot shaft; the portion of the base rod adjacent to the second end portion of the base rod is pivotally connected to an eighth connecting member through an eighth pivot shaft; the eighth connecting member is connected to the armrest and the eighth connecting member is slidable along the armrest; and the seventh pivot shaft, the eighth pivot shaft and the first pivot shaft are parallel to each other;

the second connecting member comprises a first limiting portion with a first limiting notch; and the second pivot shaft penetrates through the base rod and two side walls forming the first limiting notch;

when the rocking chair is unfolded, the base rod falls into the first limiting notch and the base rod is supported by a bottom of the first limiting notch;

the third connecting member comprises a second limiting portion with a second limiting notch; and the third pivot shaft penetrates through the rocker and two side walls forming the second limiting notch; and when the rocking chair is unfolded, the rocker is embedded into the second limiting notch and the rocker is pressed by a bottom of the second limiting notch.

10. The rocking chair according to claim 6, further comprising a front intersecting mechanism and a rear intersecting mechanism;

the front intersecting mechanism comprises a first front slanting rod and a second front slanting rod, and the first front slanting rod and the second front slanting rod intersect and are pivotally connected at a second intersection by a tenth pivot shaft; a first end portion of the first front slanting rod is pivotally connected to a first angle cleat through an eleventh pivot shaft; a first end portion of the second front slanting rod is pivotally connected to a second angle cleat through a twelfth pivot shaft; the first angle cleat is pivotally connected to the third support rod of a first folding mechanism of the two folding mechanisms through a thirteenth pivot shaft; the second angle cleat is pivotally connected to the third support rod of a second folding mechanism of the two folding mechanisms through a fourteenth pivot shaft; the thirteenth pivot shaft and the fourteenth pivot shaft are respectively adjacent to two fifth pivot shafts; alternatively, the thirteenth pivot shaft and the fourteenth pivot shaft are respectively the two fifth pivot shafts; and the thirteenth pivot shaft and the fourteenth pivot shaft are symmetric about the center plane;

a second end portion of the first front slanting rod is pivotally connected to a third angle cleat through a fifteenth pivot shaft; a second end portion of the second front slanting rod is pivotally connected to a fourth angle cleat through a sixteenth pivot shaft; the third angle cleat is pivotally connected to the third connecting member of the second folding mechanism of the two folding mechanisms through a seventeenth pivot shaft; the fourth angle cleat is pivotally connected to the third connecting member of the first folding mechanism of the two folding mechanisms through an eighteenth pivot shaft; and the seventeenth pivot shaft and the eighteenth pivot shaft are symmetric about the center plane;

the tenth pivot shaft is located in the center plane; the eleventh pivot shaft, the twelfth pivot shaft, the fifteenth pivot shaft and the sixteenth pivot shaft are parallel to the tenth pivot shaft;

the rear intersecting mechanism comprises a first rear slanting rod and a second rear slanting rod, and the first rear slanting rod and the second rear slanting rod intersect and are pivotally connected at a third intersection by a nineteenth pivot shaft; a first end portion of the first rear slanting rod is pivotally connected to a fifth angle cleat through a twentieth pivot shaft; a first end portion of the second rear slanting rod is pivotally connected to a sixth angle cleat through a twenty-first pivot shaft; the fifth angle cleat is pivotally connected to the backrest rod of the first folding mechanism of the two folding mechanisms through a twenty-second pivot shaft; the sixth angle cleat is pivotally connected to the backrest rod of the second folding mechanism of the two folding mechanisms through a twenty-third pivot shaft; and the twenty-second pivot shaft and the twenty-third pivot shaft symmetric about the center plane;

a second end portion of the first rear slanting rod is pivotally connected to a seventh angle cleat through a twenty-fourth pivot shaft; a second end portion of the second rear slanting rod is pivotally connected to an eighth angle cleat through a twenty-fifth pivot shaft; the seventh angle cleat is pivotally connected to the sixth connecting member of the second folding mechanism of the two folding mechanisms through a twenty-sixth pivot shaft; the eighth angle cleat is pivotally connected to the sixth connecting member of the first folding mechanism of the two folding mechanisms through a twenty-seventh pivot shaft; and the twenty-sixth pivot shaft and the twenty-seventh pivot shaft are symmetric about the center plane; and the nineteenth pivot shaft is located in the center plane; and the twentieth pivot shaft, the twenty-first pivot shaft, the twenty-fourth pivot shaft and the twenty-fifth pivot shaft are parallel to the nineteenth pivot shaft; and the two slanting rods are pivotally connected by a twenty-eighth pivot shaft; the first end portions of the two slanting rods are respectively pivotally connected to a ninth angle cleat and a tenth angle cleat at a twenty-ninth pivot shaft and a thirtieth pivot shaft; the ninth angle cleat and the tenth angle cleat are respectively pivotally connected to the two side support rods at a thirty-first pivot shaft and a thirty-second pivot shaft; the second end portions of the two slanting rods are respectively pivotally connected to an eleventh angle cleat and a twelfth angle cleat at a thirty-third pivot shaft and a thirty-fourth pivot shaft; and the eleventh angle cleat and the twelfth angle cleat are respectively pivotally connected to the two bottom rods at a thirty-fifth pivot shaft and a thirty-sixth pivot shaft.

11. The rocking chair according to claim 7, wherein further comprising a front intersecting mechanism and a rear intersecting mechanism;

the front intersecting mechanism comprises a first front slanting rod and a second front slanting rod, and the first front slanting rod and the second front slanting rod intersect and are pivotally connected at a second intersection by a tenth pivot shaft; a first end portion of the first front slanting rod is pivotally connected to a first angle cleat through an eleventh pivot shaft; a first end portion of the second front slanting rod is pivotally connected to a second angle cleat through a twelfth pivot shaft; the first angle cleat is pivotally connected to the third support rod of a first folding mechanism of the two folding mechanisms through a thirteenth pivot shaft; the second angle cleat is pivotally connected to the third support rod of a second folding mechanism of the two folding mechanisms through a fourteenth pivot shaft; the thirteenth pivot shaft and the fourteenth pivot shaft are respectively adjacent to two fifth pivot shafts; alternatively, the thirteenth pivot shaft and the fourteenth pivot shaft are respectively the two fifth pivot shafts; and the thirteenth pivot shaft and the fourteenth pivot shaft are symmetric about the center plane;

a second end portion of the first front slanting rod is pivotally connected to a third angle cleat through a fifteenth pivot shaft; a second end portion of the second front slanting rod is pivotally connected to a fourth angle cleat through a sixteenth pivot shaft; the third angle cleat is pivotally connected to the third connecting member of the second folding mechanism of the two folding mechanisms through a seventeenth pivot shaft; the fourth angle cleat is pivotally connected to the third connecting member of the first folding mechanism of the two folding mechanisms through an eighteenth pivot shaft; and the seventeenth pivot shaft and the eighteenth pivot shaft are symmetric about the center plane;

the tenth pivot shaft is located in the center plane; the eleventh pivot shaft, the twelfth pivot shaft, the fifteenth pivot shaft and the sixteenth pivot shaft are parallel to the tenth pivot shaft;

the rear intersecting mechanism comprises a first rear slanting rod and a second rear slanting rod, and the first rear slanting rod and the second rear slanting rod intersect and are pivotally connected at a third intersection by a nineteenth pivot shaft; a first end portion of the first rear slanting rod is pivotally connected to a fifth angle cleat through a twentieth pivot shaft; a first end portion of the second rear slanting rod is pivotally connected to a sixth angle cleat through a twenty-first pivot shaft; the fifth angle cleat is pivotally connected to the backrest rod of the first folding mechanism of the two folding mechanisms through a twenty-second pivot shaft; the sixth angle cleat is pivotally connected to the backrest rod of the second folding mechanism of the two folding mechanisms through a twenty-third pivot shaft; and the twenty-second pivot shaft and the twenty-third pivot shaft symmetric about the center plane;

a second end portion of the first rear slanting rod is pivotally connected to a seventh angle cleat through a twenty-fourth pivot shaft; a second end portion of the second rear slanting rod is pivotally connected to an eighth angle cleat through a twenty-fifth pivot shaft; the seventh angle cleat is pivotally connected to the sixth connecting member of the second folding mechanism of the two folding mechanisms through a twenty-sixth pivot shaft; the eighth angle cleat is pivotally connected to the sixth connecting member of the first folding mechanism of the two folding mechanisms through a twenty-seventh pivot shaft; and the twenty-sixth pivot shaft and the twenty-seventh pivot shaft are symmetric about the center plane; and the nineteenth pivot shaft is located in the center plane; and the twentieth pivot shaft, the twenty-first pivot shaft, the twenty-fourth pivot shaft and the twenty-fifth pivot shaft are parallel to the nineteenth pivot shaft; and the two slanting rods are pivotally connected by a twenty-eighth pivot shaft; the first end portions of the two slanting rods are respectively pivotally connected to a ninth angle cleat and a tenth angle cleat at a twenty-ninth pivot shaft and a thirtieth pivot shaft; the ninth angle cleat and the tenth angle cleat are respectively pivotally connected to the two side support rods at a thirty-first pivot shaft and a thirty-second pivot shaft; the second end portions of the two slanting rods are respectively pivotally connected to an eleventh angle cleat and a twelfth angle cleat at a thirty-third pivot shaft and a thirty-fourth pivot shaft; and the eleventh angle cleat and the twelfth angle cleat are respectively pivotally connected to the two bottom rods at a thirty-fifth pivot shaft and a thirty-sixth pivot shaft.

12. The rocking chair according to claim 8, wherein further comprising a front intersecting mechanism and a rear intersecting mechanism;

the front intersecting mechanism comprises a first front slanting rod and a second front slanting rod, and the first front slanting rod and the second front slanting rod intersect and are pivotally connected at a second intersection by a tenth pivot shaft; a first end portion of the first front slanting rod is pivotally connected to a first angle cleat through an eleventh pivot shaft; a first end portion of the second front slanting rod is pivotally connected to a second angle cleat through a twelfth pivot shaft; the first angle cleat is pivotally connected to the third support rod of a first folding mechanism of the two folding mechanisms through a thirteenth pivot shaft; the second angle cleat is pivotally connected to the third support rod of a second folding mechanism of the two folding mechanisms through a fourteenth pivot shaft; the thirteenth pivot shaft and the fourteenth pivot shaft are respectively adjacent to two fifth pivot shafts; alternatively, the thirteenth pivot shaft and the fourteenth pivot shaft are respectively the two fifth pivot shafts; and the thirteenth pivot shaft and the fourteenth pivot shaft are symmetric about the center plane;

a second end portion of the first front slanting rod is pivotally connected to a third angle cleat through a fifteenth pivot shaft; a second end portion of the second front slanting rod is pivotally connected to a fourth angle cleat through a sixteenth pivot shaft; the third angle cleat is pivotally connected to the third connecting member of the second folding mechanism of the two folding mechanisms through a seventeenth pivot shaft; the fourth angle cleat is pivotally connected to the third connecting member of the first folding mechanism of the two folding mechanisms through an eighteenth pivot shaft; and the seventeenth pivot shaft and the eighteenth pivot shaft are symmetric about the center plane;

the tenth pivot shaft is located in the center plane; the eleventh pivot shaft, the twelfth pivot shaft, the fifteenth pivot shaft and the sixteenth pivot shaft are parallel to the tenth pivot shaft;

the rear intersecting mechanism comprises a first rear slanting rod and a second rear slanting rod, and the first rear slanting rod and the second rear slanting rod intersect and are pivotally connected at a third intersection by a nineteenth pivot shaft; a first end portion of the first rear slanting rod is pivotally connected to a fifth angle cleat through a twentieth pivot shaft; a first end portion of the second rear slanting rod is pivotally connected to a sixth angle cleat through a twenty-first pivot shaft; the fifth angle cleat is pivotally connected to the backrest rod of the first folding mechanism of the two folding mechanisms through a twenty-second pivot shaft; the sixth angle cleat is pivotally connected to the backrest rod of the second folding mechanism of the two folding mechanisms through a twenty-third pivot shaft; and the twenty-second pivot shaft and the twenty-third pivot shaft symmetric about the center plane;

a second end portion of the first rear slanting rod is pivotally connected to a seventh angle cleat through a twenty-fourth pivot shaft; a second end portion of the second rear slanting rod is pivotally connected to an eighth angle cleat through a twenty-fifth pivot shaft; the seventh angle cleat is pivotally connected to the sixth connecting member of the second folding mechanism of the two folding mechanisms through a twenty-sixth pivot shaft; the eighth angle cleat is pivotally connected to the sixth connecting member of the first folding mechanism of the two folding mechanisms through a twenty-seventh pivot shaft; and the twenty-sixth pivot shaft and the twenty-seventh pivot shaft are symmetric about the center plane; and the nineteenth pivot shaft is located in the center plane; and the twentieth pivot shaft, the twenty-first pivot shaft, the twenty-fourth pivot shaft and the twenty-fifth pivot shaft are parallel to the nineteenth pivot shaft; and the two slanting rods are pivotally connected by a twenty-eighth pivot shaft; the first end portions of the two slanting rods are respectively pivotally connected to a ninth angle cleat and a tenth angle cleat at a twenty-ninth pivot shaft and a thirtieth pivot shaft; the ninth angle cleat and the tenth angle cleat are respectively pivotally connected to the two side support rods at a thirty-first pivot shaft and a thirty-second pivot shaft; the second end portions of the two slanting rods are respectively pivotally connected to an eleventh angle cleat and a twelfth angle cleat at a thirty-third pivot shaft and a thirty-fourth pivot shaft; and the eleventh angle cleat and the twelfth angle cleat are respectively pivotally connected to the two bottom rods at a thirty-fifth pivot shaft and a thirty-sixth pivot shaft.

13. The rocking chair according to claim 9, wherein further comprising a front intersecting mechanism and a rear intersecting mechanism;

the front intersecting mechanism comprises a first front slanting rod and a second front slanting rod, and the first front slanting rod and the second front slanting rod intersect and are pivotally connected at a second intersection by a tenth pivot shaft; a first end portion of the first front slanting rod is pivotally connected to a first angle cleat through an eleventh pivot shaft; a first end portion of the second front slanting rod is pivotally connected to a second angle cleat through a twelfth pivot shaft; the first angle cleat is pivotally connected to the third support rod of a first folding mechanism of the two folding mechanisms through a thirteenth pivot shaft; the second angle cleat is pivotally connected to the third support rod of a second folding mechanism of the two folding mechanisms through a fourteenth pivot shaft; the thirteenth pivot shaft and the fourteenth pivot shaft are respectively adjacent to two fifth pivot shafts; alternatively, the thirteenth pivot shaft and the fourteenth pivot shaft are respectively the two fifth pivot shafts; and the thirteenth pivot shaft and the fourteenth pivot shaft are symmetric about the center plane;

a second end portion of the first front slanting rod is pivotally connected to a third angle cleat through a fifteenth pivot shaft; a second end portion of the second front slanting rod is pivotally connected to a fourth angle cleat through a sixteenth pivot shaft; the third angle cleat is pivotally connected to the third connecting member of the second folding mechanism of the two folding mechanisms through a seventeenth pivot shaft; the fourth angle cleat is pivotally connected to the third connecting member of the first folding mechanism of the two folding mechanisms through an eighteenth pivot shaft; and the seventeenth pivot shaft and the eighteenth pivot shaft are symmetric about the center plane;

the tenth pivot shaft is located in the center plane; the eleventh pivot shaft, the twelfth pivot shaft, the fifteenth pivot shaft and the sixteenth pivot shaft are parallel to the tenth pivot shaft;

the rear intersecting mechanism comprises a first rear slanting rod and a second rear slanting rod, and the first rear slanting rod and the second rear slanting rod intersect and are pivotally connected at a third intersection by a nineteenth pivot shaft; a first end portion of the first rear slanting rod is pivotally connected to a fifth angle cleat through a twentieth pivot shaft; a first end portion of the second rear slanting rod is pivotally connected to a sixth angle cleat through a twenty-first pivot shaft; the fifth angle cleat is pivotally connected to the backrest rod of the first folding mechanism of the two folding mechanisms through a twenty-second pivot shaft; the sixth angle cleat is pivotally connected to the backrest rod of the second folding mechanism of the two folding mechanisms through a twenty-third pivot shaft; and the twenty-second pivot shaft and the twenty-third pivot shaft symmetric about the center plane;

a second end portion of the first rear slanting rod is pivotally connected to a seventh angle cleat through a twenty-fourth pivot shaft; a second end portion of the second rear slanting rod is pivotally connected to an eighth angle cleat through a twenty-fifth pivot shaft; the seventh angle cleat is pivotally connected to the sixth connecting member of the second folding mechanism of the two folding mechanisms through a twenty-sixth pivot shaft; the eighth angle cleat is pivotally connected to the sixth connecting member of the first folding mechanism of the two folding mechanisms through a twenty-seventh pivot shaft; and the twenty-sixth pivot shaft and the twenty-seventh pivot shaft are symmetric about the center plane; and the nineteenth pivot shaft is located in the center plane; and the twentieth pivot shaft, the twenty-first pivot shaft, the twenty-fourth pivot shaft and the twenty-fifth pivot shaft are parallel to the nineteenth pivot shaft; and the two slanting rods are pivotally connected by a twenty-eighth pivot shaft; the first end portions of the two slanting rods are respectively pivotally connected to a ninth angle cleat and a tenth angle cleat at a twenty-ninth pivot shaft and a thirtieth pivot shaft; the ninth angle cleat and the tenth angle cleat are respectively pivotally connected to the two side support rods at a thirty-first pivot shaft and a thirty-second pivot shaft; the second end portions of the two slanting rods are respectively pivotally connected to an eleventh angle cleat and a twelfth angle cleat at a thirty-third pivot shaft and a thirty-fourth pivot shaft; and the eleventh angle cleat and the twelfth angle cleat are respectively pivotally connected to the two bottom rods at a thirty-fifth pivot shaft and a thirty-sixth pivot shaft.

14. The rocking chair according to claim 10, wherein the twenty-sixth pivot shaft is the sixth pivot shaft of the second folding mechanism of the two folding mechanisms, and the twenty-seventh pivot shaft is the sixth pivot shaft of the first folding mechanism of the two folding mechanisms; and each of the two folding mechanisms further comprises a fifth connecting member; the fifth connecting member is sleeved on the third support rod; the fifth pivot shaft penetrates through the second support rod, the third support rod and the fifth connecting member; the first angle cleat is pivotally connected to the fifth connecting member of the first folding mechanism of the two folding mechanisms through the thirteenth pivot shaft; and the second angle cleat is pivotally connected to the fifth connecting member of the second folding mechanism of the two folding mechanisms through the fourteenth pivot shaft;

the armrest is provided with a sliding groove, and the eighth connecting member comprises a slider, the slider is slidably fitted into the sliding groove; and the first connecting member comprises a first sliding sleeve, the first sliding sleeve is slidably sleeved on the rocker; and the fourth connecting member comprises a second sliding sleeve, the second sliding sleeve is slidably sleeved on the base rod.

15. The rocking chair according to claim 11, wherein the twenty-sixth pivot shaft is the sixth pivot shaft of the second folding mechanism of the two folding mechanisms, and the twenty-seventh pivot shaft is the sixth pivot shaft of the first folding mechanism of the two folding mechanisms; and each of the two folding mechanisms further comprises a fifth connecting member; the fifth connecting member is sleeved on the third support rod; the fifth pivot shaft penetrates through the second support rod, the third support rod and the fifth connecting member; the first angle cleat is pivotally connected to the fifth connecting member of the first folding mechanism of the two folding mechanisms through the thirteenth pivot shaft; and the second angle cleat is pivotally connected to the fifth connecting member of the second folding mechanism of the two folding mechanisms through the fourteenth pivot shaft;

the armrest is provided with a sliding groove, and the eighth connecting member comprises a slider, the slider is slidably fitted into the sliding groove; and the first connecting member comprises a first sliding sleeve, the first sliding sleeve is slidably sleeved on the rocker; and the fourth connecting member comprises a second sliding sleeve, the second sliding sleeve is slidably sleeved on the base rod.

16. The rocking chair according to claim 12, wherein the twenty-sixth pivot shaft is the sixth pivot shaft of the second folding mechanism of the two folding mechanisms, and the twenty-seventh pivot shaft is the sixth pivot shaft of the first folding mechanism of the two folding mechanisms; and each of the two folding mechanisms further comprises a fifth connecting member; the fifth connecting member is sleeved on the third support rod; the fifth pivot shaft penetrates through the second support rod, the third support rod and the fifth connecting member; the first angle cleat is pivotally connected to the fifth connecting member of the first folding mechanism of the two folding mechanisms through the thirteenth pivot shaft; and the second angle cleat is pivotally connected to the fifth connecting member of the second folding mechanism of the two folding mechanisms through the fourteenth pivot shaft;

the armrest is provided with a sliding groove, and the eighth connecting member comprises a slider, the slider is slidably fitted into the sliding groove; and the first connecting member comprises a first sliding sleeve, the first sliding sleeve is slidably sleeved on the rocker; and the fourth connecting member comprises a second sliding sleeve, the second sliding sleeve is slidably sleeved on the base rod.

17. The rocking chair according to claim 13, wherein the twenty-sixth pivot shaft is the sixth pivot shaft of the second folding mechanism of the two folding mechanisms, and the twenty-seventh pivot shaft is the sixth pivot shaft of the first folding mechanism of the two folding mechanisms; and each of the two folding mechanisms further comprises a fifth connecting member; the fifth connecting member is sleeved on the third support rod; the fifth pivot shaft penetrates through the second support rod, the third support rod and the fifth connecting member; the first angle cleat is pivotally connected to the fifth connecting member of the first folding mechanism of the two folding mechanisms through the thirteenth pivot shaft; and the second angle cleat is pivotally connected to the fifth connecting member of the second folding mechanism of the two folding mechanisms through the fourteenth pivot shaft;

the armrest is provided with a sliding groove, and the eighth connecting member comprises a slider, the slider is slidably fitted into the sliding groove; and the first connecting member comprises a first sliding sleeve, the first sliding sleeve is slidably sleeved on the rocker; and the fourth connecting member comprises a second sliding sleeve, the second sliding sleeve is slidably sleeved on the base rod.

* * * * *